US005501399A

United States Patent [19]

Cienkus

[11] Patent Number: 5,501,399

[45] Date of Patent: Mar. 26, 1996

[54] AUTOMOBILE WHEEL CLEANING DEVICE

[76] Inventor: Joseph P. Cienkus, 9121 Doubloon Rd., Indianapolis, Ind. 46268

[21] Appl. No.: 254,554

[22] Filed: Jun. 6, 1994

[51] Int. Cl.[6] ..... B05B 7/04

[52] U.S. Cl. ..... 239/310; 239/375; 401/204; 401/42

[58] Field of Search ..... 239/310, 375, 239/525, 530, 581.1; 401/203, 204, 42, 43, 46, 47

[56] References Cited

U.S. PATENT DOCUMENTS

| | | | |
|---|---|---|---|
| 800,254 | 9/1905 | Willis | 401/204 |
| 1,218,081 | 3/1917 | Hahn | 401/203 |
| 1,367,758 | 2/1921 | Strieff | 401/203 |
| 1,394,282 | 10/1921 | Crosby | 401/204 |
| 1,410,620 | 3/1922 | Strieff | 401/203 |
| 2,250,909 | 7/1941 | Habeck | 401/204 |
| 2,265,804 | 12/1941 | Deady | 401/203 |
| 2,288,353 | 6/1942 | Hiatt | 401/203 |
| 2,779,962 | 2/1957 | Cooper | 401/42 |
| 2,904,809 | 9/1959 | Clayson | 401/203 X |
| 2,940,102 | 6/1960 | Marinus | 401/203 |
| 3,009,190 | 11/1961 | Awot | 401/46 |
| 3,042,315 | 7/1962 | Besser | 239/582.1 X |
| 3,063,084 | 11/1962 | Marinus | 401/203 |
| 3,089,181 | 5/1963 | Hess | 401/46 |
| 3,359,591 | 12/1967 | McGuire | 401/203 |
| 3,412,941 | 11/1968 | Steinback | 239/581.1 |
| 3,470,826 | 10/1969 | Foulds | 401/203 X |
| 4,032,239 | 6/1977 | Maupin | 401/203 |
| 4,281,796 | 8/1981 | Fugent et al. | 239/581.1 X |
| 4,618,279 | 10/1986 | Gurevich et al. | 401/42 X |
| 4,696,593 | 9/1987 | Bayless | 401/42 X |
| 4,819,872 | 4/1989 | Rosenberg | 239/581.1 X |

FOREIGN PATENT DOCUMENTS

| | | | |
|---|---|---|---|
| 271593 | 11/1965 | Australia | 401/203 |
| 554858 | 2/1957 | Belgium | 401/203 |
| 630997 | 4/1964 | Belgium | 401/203 |
| 1077998 | 3/1960 | Germany | 401/204 |
| 258484 | 5/1949 | Switzerland | 401/203 |
| 893496 | 4/1962 | United Kingdom | 401/203 |

*Primary Examiner*—Andres Kashnikow
*Assistant Examiner*—Lesley D. Morris

[57] ABSTRACT

An automobile wheel cleaning device comprises a regulator shaft formed in a hollow generally cylindrical configuration with a first open end and a second open end. The shaft includes a coupling device on its second open end which is adapted to be coupled with the end of a standard garden hose in the operative orientation. A restrictor dial includes a finger grip and is positioned outside the shaft. A valve is formed in a generally planar circular configuration and is positioned within the hollow interior of the regulator shaft. A rod extends through the shaft and connects the finger grip and valve. The regulator dial is adapted to allow a user to regulate the flow of water therethrough. A cleaning head is comprised of a foamed elastomer and formed in a hollow generally cylindrical configuration. The head includes an open end which is adapted to be positioned around the first open end of the regulator shaft. The cleaning head includes a plurality of apertures adapted to permit the free flow of water therethrough in the operative orientation.

1 Claim, 4 Drawing Sheets

AUTOMOBILE WHEEL CLEANING DEVICE

BACKGROUND OF THE INVENTION

1. Field of the Invention

The present invention relates to automobile wheel cleaning devices and more particularly pertains to cleaning automobile wheels with the specially contoured cleaning head of the apparatus.

2. Description of the Prior Art

The use of spray cleaning devices is known in the prior art. More specifically, spray cleaning devices heretofore devised and utilized for the purpose of cleaning automobiles and their accessories with concentrated water spray are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 4,279,051 to Malcolm a combination water spray and rotary brush attachment.

U.S. Pat. No. 4,403,737 to Hancock discloses a combination water-hose-powered garden/agricultural sprayers and special nozzle.

U.S. Pat. No. 5,022,586 to Putnam discloses a gutter cleaning device.

U.S. Pat. No. 4,750,883 to Drake discloses a device for cleaning rain gutters.

Lastly, U.S. Pat. No. 4,363,335 to Tapper discloses a gutter cleaner.

In this respect, the automobile wheel cleaning devices according to the present invention substantially depart from the conventional concepts and designs of the prior art, and in doing so provide an apparatus primarily developed for the purpose of cleaning automobile wheels with the specially contoured cleaning head of the apparatus.

Therefore, it can be appreciated that there exists a continuing need for new and improved automobile wheel cleaning devices which can be used for cleaning automobile wheels with the specially contoured cleaning head of the apparatus. In this regard, the present invention substantially fulfills this need.

SUMMARY OF THE INVENTION

In view of the foregoing disadvantages inherent in the known types of spray cleaning devices now present in the prior art, the present invention provides an improved automobile wheel cleaning device. As such, the general purpose of the present invention, which will be described subsequently in greater detail, is to provide a new and improved automobile wheel cleaning device and method which has all the advantages of the prior art and none of the disadvantages.

To attain this, the present invention essentially comprises a new and improved automobile wheel cleaning device comprising a regulator shaft fabricated of reinforced rubber and formed in a hollow generally cylindrical configuration. The shaft includes a first open end and a second open end. The shaft has an inboard region adjacent to the first open end, an outboard region adjacent to the second open end, and a central region therebetween. The inboard region measures about one-half of the length of the outboard region. A hollow generally cylindrical collar is affixed to the second open end.

The collar has an inner surface, an outer surface and two open ends. The collar has a larger circumference than the outboard region and includes a plurality of internal screw threads on its inner surface. A washer shaped in a ring configuration is positioned inside the collar. The collar is adapted to be coupled with the end of a standard garden hose in the operative orientation. The outboard region of the regulator shaft is adapted to receive a soap pellet encassed in an envelope. When utilizing the apparatus, the soap pellet gradually dissolves and flows to the cleaning head of the apparatus. The central region is enlarged to form a generally spherical chamber and includes a circular hole extending through its surface into the hollow interior.

A restrictor dial includes a plate formed in a generally planar cylindrical configuration with an upper surface and a lower surface. The upper surface includes a generally planar rectangular finger grip which extends perpendicularly therefrom. The finger grip is positioned diametrically across the center point of the upper surface of the plate. A valve formed in a generally planar circular configuration is positioned within the chamber of the regulator shaft. The valve includes a small generally cylindrical rod extending from one of its edges and into the surface of the shaft. An axle is formed in a generally cylindrical configuration and is positioned through the circular hole in the central region. One end of the axle is affixed to the center point of the lower surface of the plate and the other end is affixed to the edge of the valve located diametrically opposite from the rod. The regulator dial is adapted to allow a user to regulate the flow of water therethrough by turning the dial to a plurality of open positions.

A cleaning head is comprised of micro cell polyurethane foam and formed in a hollow generally cylindrical configuration. The head has an inner section, an outer section, a central section and two opposing side edges. The side edges form a V-shaped configuration and are positioned diametrically opposite from each other. The central section has a large width and is positioned between the inner and outer sections. The outer section forms a point at its outermost extent and has a gradually decreasing width between its point and the central section. The inner section includes an open end at its innermost extent and has a gradually decreasing width between its open end and the central section. The open end of the inner region is adapted to be positioned around the open end of the inboard section of the regulator shaft. The cleaning head also includes a plurality of apertures adapted to permit the free flow of water therethrough in the operative orientation. A clip is shaped in a ring configuration and releasably couples the cleaning head upon the shaft. The clip is positioned around the open end of the cleaning head.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved automobile wheel cleaning devices which have all the advantages of the prior art spray cleaning devices and none of the disadvantages.

It is another object of the present invention to provide new and improved automobile wheel cleaning devices which may be easily and efficiently manufactured and marketed.

It is a further object of the present invention to provide new and improved automobile wheel cleaning devices which are of durable and reliable constructions.

An even further object of the present invention is to provide new and improved automobile wheel cleaning devices which are susceptible of a low cost of manufacture with regard to both materials and labor, and which accordingly are then susceptible of low prices of sale to the consuming public, thereby making such automobile wheel cleaning devices economically available to the buying public.

Still yet another object of the present invention is to provide new and improved automobile wheel cleaning devices which provide in the apparatuses and methods of the prior art some of the advantages thereof, while simultaneously overcoming some of the disadvantages normally associated therewith.

Still another object of the present invention is to cleaning automobile wheels with the specially contoured cleaning head of the apparatus.

Lastly, it is an object of the present invention to provide new and improved automobile wheel cleaning devices comprising a regulator shaft formed in a hollow generally cylindrical configuration with a first open end and a second open end. The shaft includes a coupling device on its second open end which is adapted to be coupled with the end of a standard garden hose in the operative orientation. A restrictor dial includes a finger grip and is positioned outside the shaft. A valve is formed in a generally planar circular configuration and is positioned within the hollow interior of the regulator shaft. A rod extends through the shaft and connects the finger grip and valve. The regulator dial is adapted to allow a user to regulate the flow of water therethrough. A cleaning head is comprised of a foamed elastomer and formed in a hollow generally cylindrical configuration. The head includes an open end which is adapted to be positioned around the first open end of the regulator shaft. The cleaning head includes a plurality of apertures adapted to permit the free flow of water therethrough in the operative orientation.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
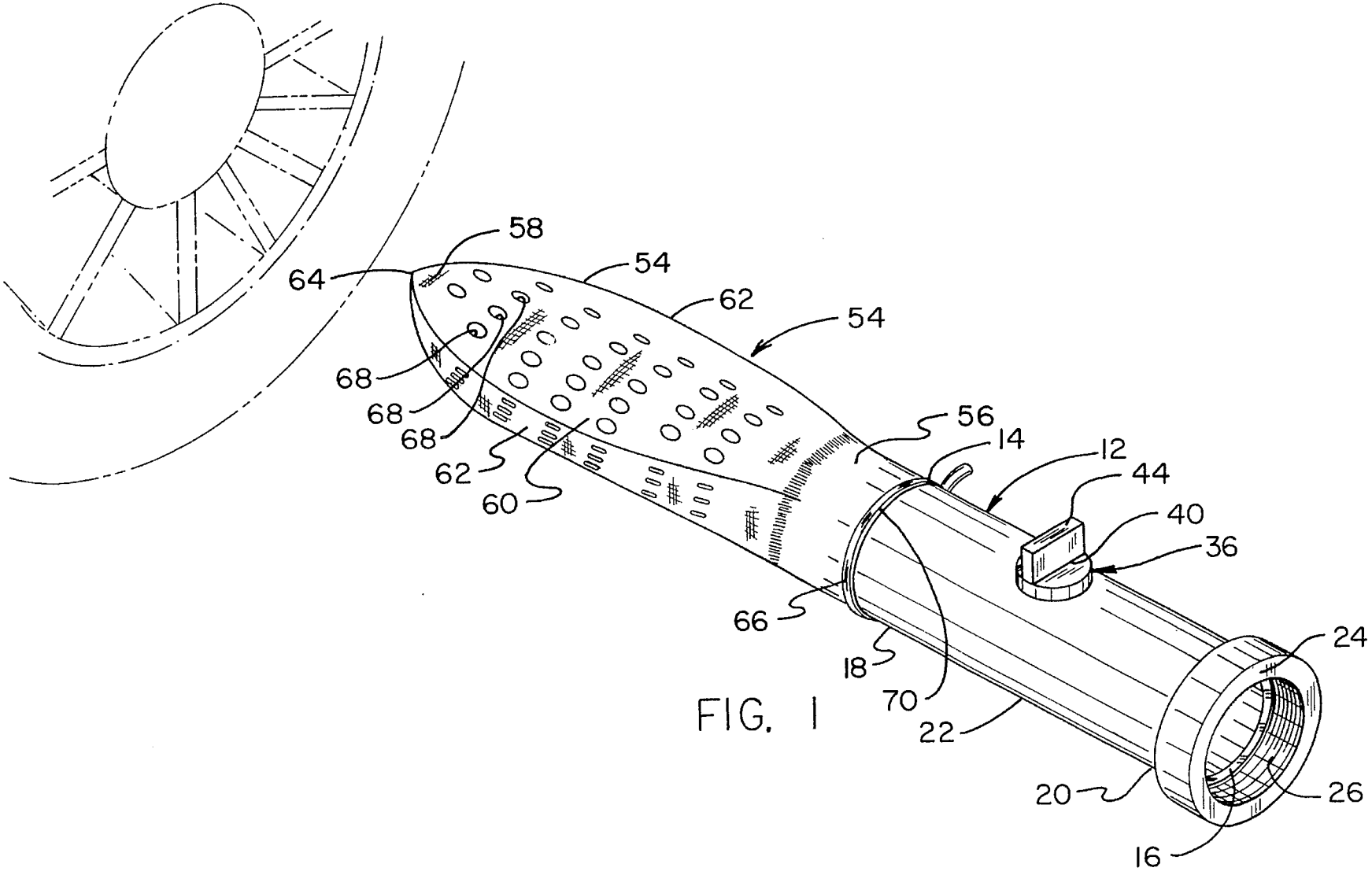
FIG. 1 is a perspective view of a preferred embodiment of the automobile wheel cleaning device constructed in accordance with the principles of the present invention.
Figure 2:
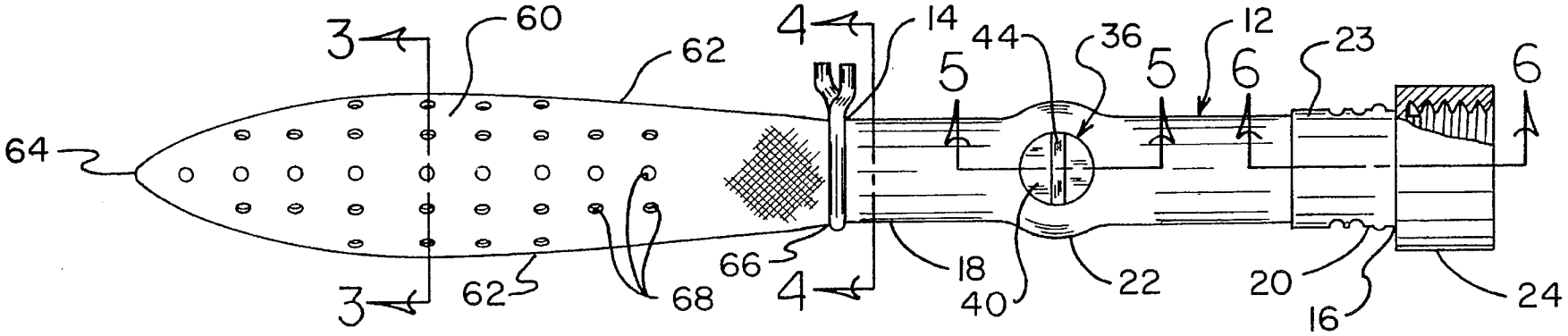
FIG. 2 is partially broken away perspective view of the apparatus shown in FIG. 1.
Figure 3:
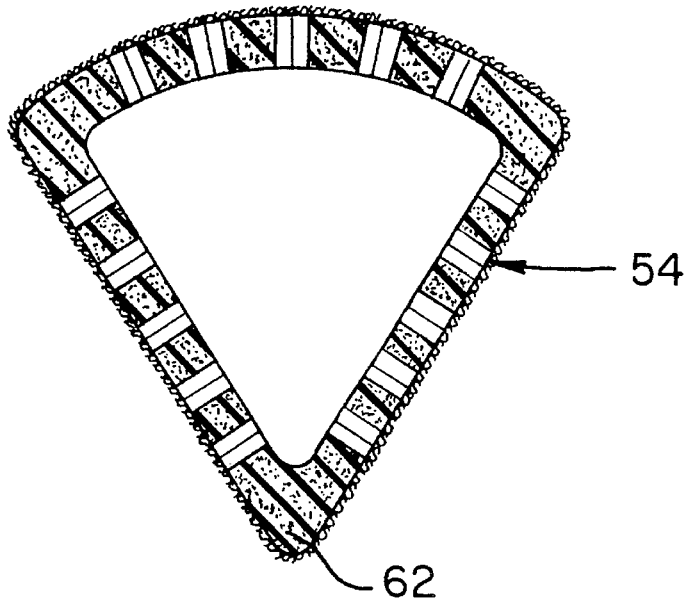
FIG. 3 is a cross sectional view of the cleaning head of the apparatus taken along line 3—3 of FIG. 2.
Figure 4:
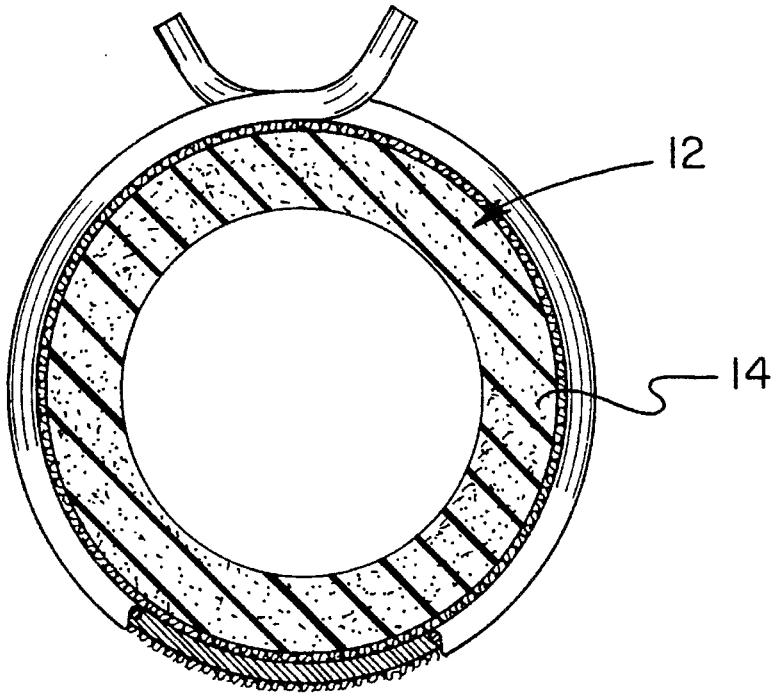
FIG. 4 is a cross sectional view of the regulator shaft of the apparatus taken along line 4—4 of FIG. 2.
Figure 5:
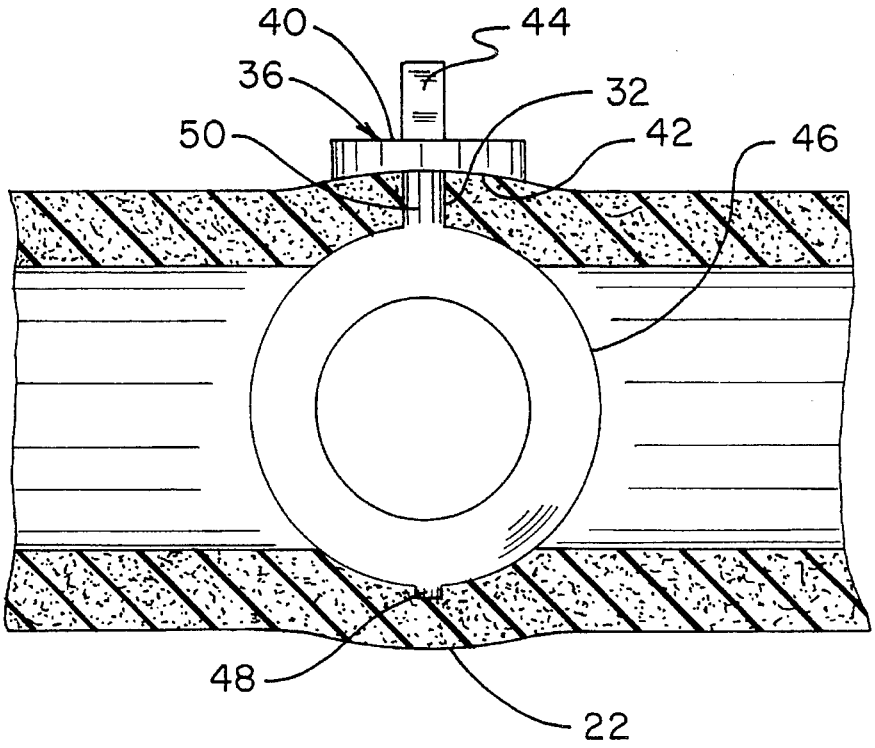
FIG. 5 is a cross sectional view of the regulator shaft of the apparatus taken along line 5—5 of FIG. 2 illustrating the restrictor dial component of the apparatus.
Figure 6:
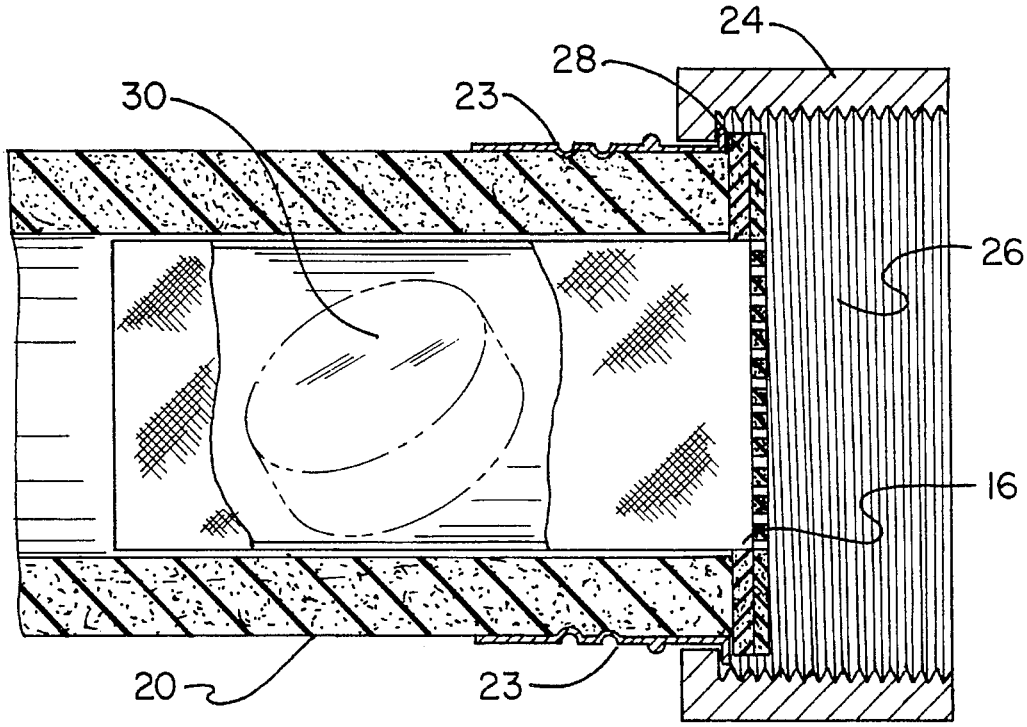
FIG. 6 is a cross sectional view of the regulator shaft of the apparatus taken along line 6—6 of FIG. 2.

With reference now to the drawings, and in particular to FIG. 1 thereof, the preferred embodiment of the new and improved automobile wheel cleaning device embodying the principles and concepts of the present invention and generally designated by the reference numeral 10 will be described.

Specifically, it will be noted in FIGS. 1 through 6, that there is provided a new and improved automobile wheel cleaning device. The automobile wheel cleaning device 10, in its broadest context, comprises a regulator shaft 12, a restrictor dial 36 and a cleaning head 54.

More specifically, the regulator shaft 12 is fabricated of reinforced rubber and is formed in a hollow generally cylindrical configuration. The shaft is made out of generally the same material as common garden hoses. The shaft includes a first open end 14 and a second open end 16. The shaft has an inboard region 18 adjacent to the first open end, an outboard region 20 adjacent to the second open end, and a central region 22 therebetween. Note FIGS. 1 and 4.

The inboard region measures about one-half of the length of the outboard region. A hollow generally cylindrical collar 24 is affixed to the second open end. A malleable metal sheet 23 is attached to the collar and positioned over the second open end. The collar can be removed with a common pliers tool if replacement is necessary. The collar has an inner surface, an outer surface and two open ends. The collar has a larger circumference than the outboard region and includes a plurality of internal screw threads 26 on its inner surface. A washer 28 shaped in a ring configuration is positioned inside the collar. The collar is adapted to be coupled with the end of a standard garden hose in the operative orientation.

The washer is fabricated of rubber and insures a tight seal between the collar and a garden during use. Note FIGS. 1 and 6.

The outboard region of the regulator shaft is adapted to receive a soap pellet encased 30 in an envelope. When utilizing the apparatus, the soap pellet 30 gradually dissolves and flows to the cleaning head of the apparatus. The soap aids the user in removing dirt and grease from the wheels. The central region 22 is enlarged to form a generally spherical chamber and includes a circular hole 32 extending through its surface into the hollow interior. The chamber essentially appears as a bulge when viewed in the operative orientation. Note FIG. 2.

A restrictor dial 36 includes a plate 38 formed in a generally planar cylindrical configuration with an upper surface 40 and a lower surface 42. The upper surface includes a generally planar rectangular finger grip 44 which extends perpendicularly therefrom. The finger grip is positioned diametrically across the center point of the upper surface of the plate. The finger grip is designed to enable a user to comfortably and easily turn the dial. Note FIGS. 1 and 5.

A valve 46 formed in a generally planar circular configuration is positioned within the chamber of the regulator shaft 12. The valve is contoured to fit snugly within the chamber when positioned perpendicular to the plane of the chamber. The valve includes a small generally cylindrical rod 48 extending from one of its edges and into the surface of the regulator shaft 12. An axle 50 is formed in a generally cylindrical configuration and is positioned through the circular hole in the central region. One end of the axle is affixed to the center point of the lower surface of the plate and the other end is affixed to the edge of the valve located diametrically opposite from the rod. The rod and axle permit circular rotation of the valve thereabout. The regulator dial is adapted to allow a user to regulate the flow of water therethrough by turning the dial to a plurality of open positions. When the user desires a strong flow of water the valve is turned parallel to the flow of water. When the user desires a restricted flow of water the valve is turned perpendicular to the flow of water. Note FIG. 5.

A cleaning head 54 is comprised of micro cell polyurethane foam and formed in a hollow generally cylindrical configuration. The foam is flexible enough to permit the user to squeeze it into difficult to reach areas of the wheel. The head has an inner section 56, an outer section 58, a central section 60 and two opposing side edges 62. The side edges form a V-shaped configuration and are positioned diametrically opposite from each other. The central section has a large width and is positioned between the inner and outer sections. The outer section forms a point 64 at its outermost extent and has a gradually decreasing width between its point and the central section. The point and V-shaped side edges add rigidity to the cleaning head. The overall shape of the sponge is specifically designed to fit in between the spokes and bars of automobile wheel wells. Note FIGS. 1, 2 and 3.

The inner section includes an open end 66 at its innermost extent and has a gradually decreasing width between its open end and the central section. The open end 66 of the inner region is adapted to be positioned around the open end 14 of the inboard section of the regulator shaft. The cleaning head also includes a plurality of apertures 68 adapted to permit the free flow of water therethrough in the operative orientation. Water flows through the shaft and into the cleaning head, picking up soap along the way. The soapy water flowing through the head helps dislodge dirt and grease from the interior of the wheel well. A clip 70 is shaped in a ring configuration and releasably couples the cleaning head 54 upon the shaft. The clip 70 is positioned around the open end 66 of the cleaning head. The clip is easily removed when changing of the head or cleaning of the apparatus is desired. Note FIGS. 2 and 4.

In an alternative embodiment of the apparatus, a piece of terry cloth is used instead of the foam cleaning head. This embodiment is useful when cleaning the exterior of the wheel well or the wheels themselves.

One of the more difficult tasks in cleaning a car, truck, or van at home is getting the wheels clean. If the vehicle has spoked or cross-lace wheels, then the job is even harder. An ordinary sponge or scrub brush cannot get into all the crevasses and crannies. The owner may have to resort to cleaning them by hand using something as small as a piece of cloth wrapped around a finger. This is a time consuming and tedious way to clean the wheels. The automobile wheel cleaning device is a new product designed to make cleaning the wheels on any vehicle an easy task.

The apparatus is a hose attachment shaped especially for cleaning any type of wheel. It consists of a regulator shaft and a cleaning head. When the head is attached, the entire hose attachment is approximately eight to twelve inches long. The regulator shaft screws directly onto the end of a typical garden hose. Soap pellets encased in an envelope can be inserted in the shaft so that the soap is released into the head. A restrictor dial on the side allows the user to control the flow of water to the head.

Two types of heads can be used with the hose extension. The first is a piece of micro cell polyurethane foam approximately six inches long. It has small holes in its surface to allow the soapy water to seep through. It is appropriately configured at the end so that it fits easily into small cavities. The second head is made from a piece of terry cloth. Both are convenient and are easy to use. The automobile wheel cleaning device makes cleaning the wheels on any vehicle easier and faster, with or without soap, and with less frustration or effort.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved automobile wheel cleaning device comprising, in combination:

a regulator shaft comprised of reinforced rubber and formed in a hollow generally cylindrical configuration with a first open end and a second open end, the shaft including an inboard region adjacent to the first open end, an outboard region adjacent to the second open end and a central region therebetween, the inboard region being smaller than the outboard region, a hollow generally cylindrical collar being affixed to the second open end, the collar having an inner surface, an outer surface and two open ends, the collar having a larger circumference than the outboard region and including a plurality of internal screw threads, a washer shaped in a ring configuration being positioned inside the collar, the collar adapted to be coupled with a standard garden hose in an operative orientation, the outboard region of the regulator shaft adapted to receive a soap pellet encased in an envelope, when utilizing the apparatus, the soap pellet gradually dissolving and flowing out the inboard region of the regulator shaft, the central region being enlarged to form a generally spherical chamber and including a circular hole extending therethrough;

a restrictor dial, the dial including a plate formed in a generally planar cylindrical configuration with an upper surface and a lower surface, the upper surface including a generally planar rectangular finger grip extending perpendicularly therefrom, the finger grip positioned diametrically across the upper surface of the plate, a valve formed in a generally planar circular configuration being positioned within the chamber of the regulator shaft, the valve including a small generally cylindrical rod extending from it and rotatably affixed within the surface of the shaft, an axle formed in a generally cylindrical configuration being positioned through the chamber, a first end of the axle being affixed to the center point of the lower surface of the plate with a second end being affixed to the valve located diametrically opposite from the rod, the regulator dial adapted to allow a user to regulate water therethrough by turning the dial to a plurality of open positions;

a cleaning head comprised of micro cell polyurethane foam and formed in a hollow generally cylindrical configuration with an inner section, an outer section, a central section and two opposing side edges, the side edges forming a V-shaped configuration and positioned diametrically opposite from each other, the central section having a large width and positioned between the inner and outer sections, the outer section including an outermost extent having a point, the outer section having a gradually decreasing width between its point and the central section, the inner section including an innermost extent having an open end, the inner section having a gradually decreasing width between its open end and the central section, the open end of the inner section adapted to be positioned around the open end of the inboard section of the regulator shaft, the cleaning head also including a plurality of apertures adapted to permit the free flow of water therethrough in an operative orientation; and a clip shaped in a ring configuration and releasably coupling the cleaning head upon the shaft, the clip being positioned around the open end of the cleaning head.

* * * * *